US005312000A

United States Patent [19]

Bass

[11] Patent Number: 5,312,000

[45] Date of Patent: May 17, 1994

[54] ANTI-THEFT COSMETIC TESTER DISPLAY STAND AND THE LIKE

[76] Inventor: Pierre Bass, 921 - 26th St., Santa Monica, Calif. 90403

[21] Appl. No.: 986,073

[22] Filed: Dec. 4, 1992

[51] Int. Cl.[5] ..... A47F 7/00

[52] U.S. Cl. ..... 211/4; 211/74

[58] Field of Search ..... 211/4, 71, 74, 8, 72, 211/13

[56] References Cited

U.S. PATENT DOCUMENTS 2,205,922 6/1940 Cravaritis ..... 211/4
2,558,955 7/1951 Hilton ..... 211/71 X
3,993,452 11/1976 Moulding ..... 211/4
4,442,942 4/1984 Cuminale et al. ..... 211/4 X
4,880,122 11/1989 Martindell ..... 211/4

*Primary Examiner*—Alvin C. Chin-shue
*Assistant Examiner*—Sarah Lechok

[57] ABSTRACT

An anti-theft cosmetic tester display stand. The device has a support member and a cover member which sits over the support member. Openings are provided in the cover member, through which the upper portion of containers of cosmetic testers pass. Permanently affixed to the bottom of the containers of testers are base members which are oversized relative to the opening. The oversized base members prevent the containers of cosmetic testers from being shoplifted.

12 Claims, 5 Drawing Sheets

ANTI-THEFT COSMETIC TESTER DISPLAY STAND AND THE LIKE

BACKGROUND OF THE INVENTION

1. Field of the Invention

The invention relates to the field of display stands, particularly locking display stands for use with cosmetic tester samples.

2. Description of the Prior Art

In the retail merchandise setting, shoplifting remains a major problem. Great efforts are expended to secure items from shoplifting, such as by the use of electronic triggering devices, the use of oversized and difficult to open packaging, and devices to physically restrain merchandise.

In the field of cosmetic retailing, it is customary that cosmetic tester samples be provided for sample use by customers. However, such testers are frequently shoplifted, thereby requiring frequent restocking of these testers.

SUMMARY OF THE INVENTION

The invention provides an anti-theft tester display stand for securing a number of containers, e.g. cosmetic test samples, such that the bases of the containers cannot be withdrawn from apertures in the anti-theft cosmetic display stand due to the attachment of plates, oversized relative to the apertures, affixed to the bottom of the containers of cosmetic test samples.

An aspect of the invention is a product display stand incorporating at least one tester for a particular product lockably mounted therein, comprising:

a support member;

a cover member lockably mounted onto said support member, said cover member having at least one opening therein, dimensioned so as to permit a lower end of said tester to pass therethrough; and a base member, affixed to said tester, oversized with respect to said opening so as not to be passable through said opening through said cover member;

whereby when said tester and said base member are placed on said support and said cover member is lockably mounted to said support, said tester will be locked between said support member and said cover member, thereby preventing said tester from being removed.

Another aspect of the invention is an anti-theft cosmetic tester display stand for use with containers of cosmetic testers, comprising:

a support member having at least one generally horizontal surface;

a cover member which is sized to fit over said support portion, having at least one generally horizontal surface with at least one aperture formed therethrough, said at least one aperture being slightly larger than a container of cosmetic tester;

a lock means to selectively lock said cover member over said support member such that a space is formed between an upper surface of said support member and a lower surface of said cover member when engaged; and at least one base member, thinner in thickness than said space, and larger in size than said at least one aperture, for permanent affixation to a bottom surface of a container of cosmetic tester;

whereby when said at least one base member is permanently fixed to a container of cosmetic tester, and an upper portion of said base member affixed container of cosmetic tester is positioned to pass through said at least one aperture, and said support member and said cover member are locked together, said base member will be locked in said space and said affixed container will be prevented from being removed from said display stand.

Yet another aspect of the invention is an anti-theft cosmetic tester display stand for use with containers of cosmetic testers, comprising:

a support member;

a cover member which is sized to fit over said support member, having at least one aperture formed therethrough, said at least one aperture being dimensioned slightly larger than the container of cosmetic tester, said enclosure portion being sized to fit over said support portion such that a space is formed between an upper surface of said support member and a lower surface of said cover member;

a housing member into which said cover member, engaged with said support member, can be engaged;

a lock means to selectively lock said cover member, support member and housing member together; and at least one base member, thinner in thickness than said space, and sized larger than said at least one aperture, for permanent affixation to a bottom surface of a container of cosmetic tester;

whereby when said at least one base member is permanently fixed to a container of cosmetic tester, and an upper portion of said plate affixed container of cosmetic tester is positioned to pass through said at least one aperture, and said support member, said cover member and said receiving member are locked together, said plate will be locked in said space and said plate affixed container will be prevented from being removed from said display stand.

BRIEF DESCRIPTION OF THE DRAWINGS

The invention is described below in greater detail with reference to the drawings.

DESCRIPTION OF THE PREFERRED EMBODIMENT

Figure 1:
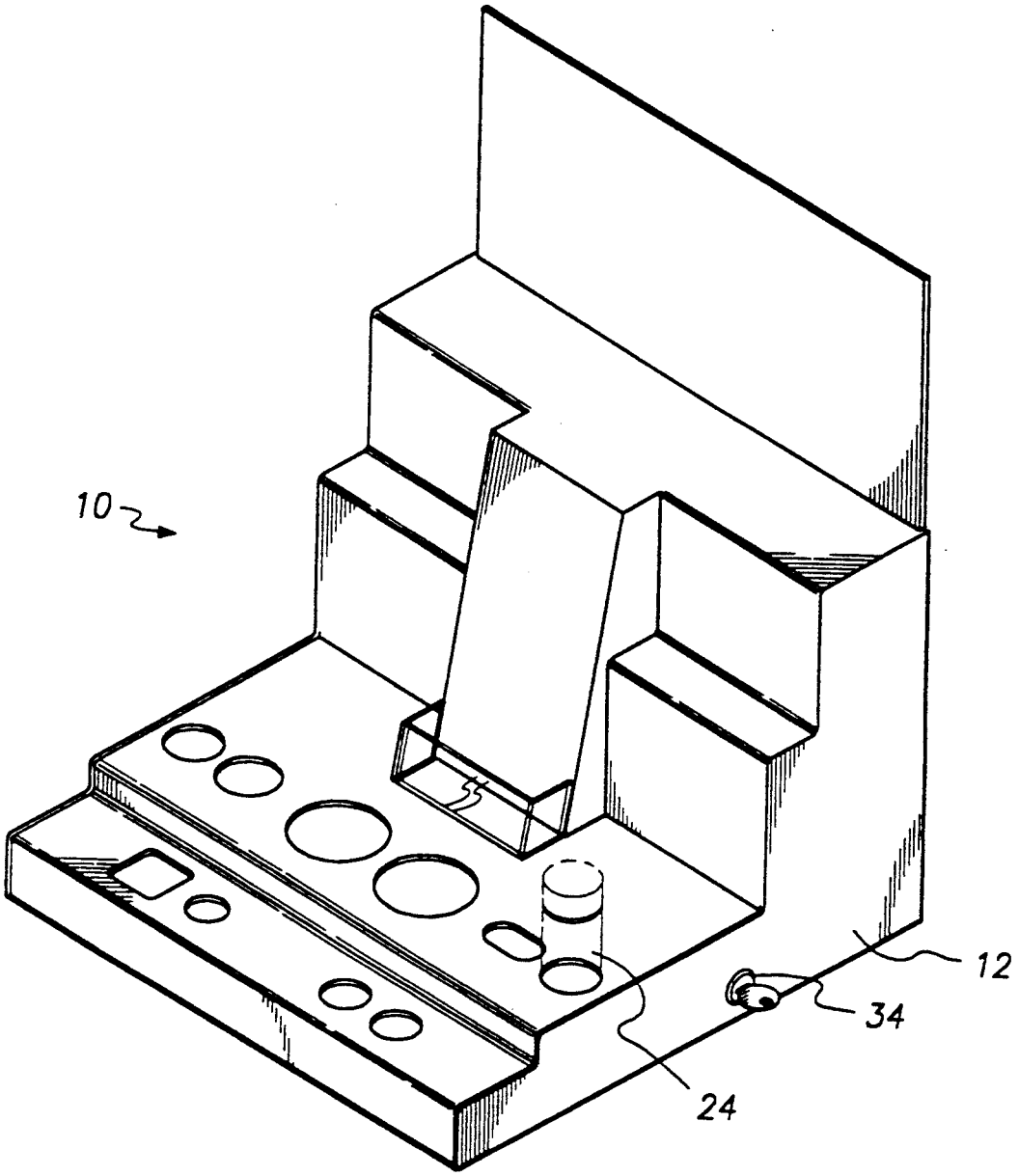
FIG. 1 is a perspective view of a first embodiment of the assembled anti-theft cosmetic tester display stand of the invention.
Figure 2:
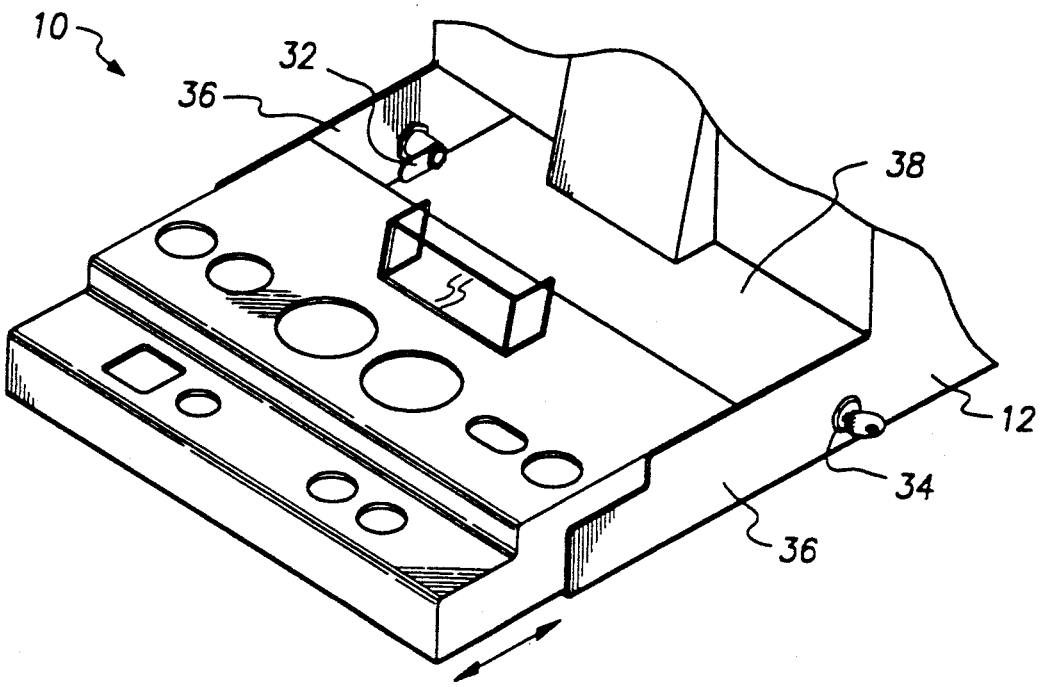
FIG. 2 is a partial perspective view illustrating the interaction of the enclosure portion and support portion with the housing portion of FIG. 1.
Figure 3:
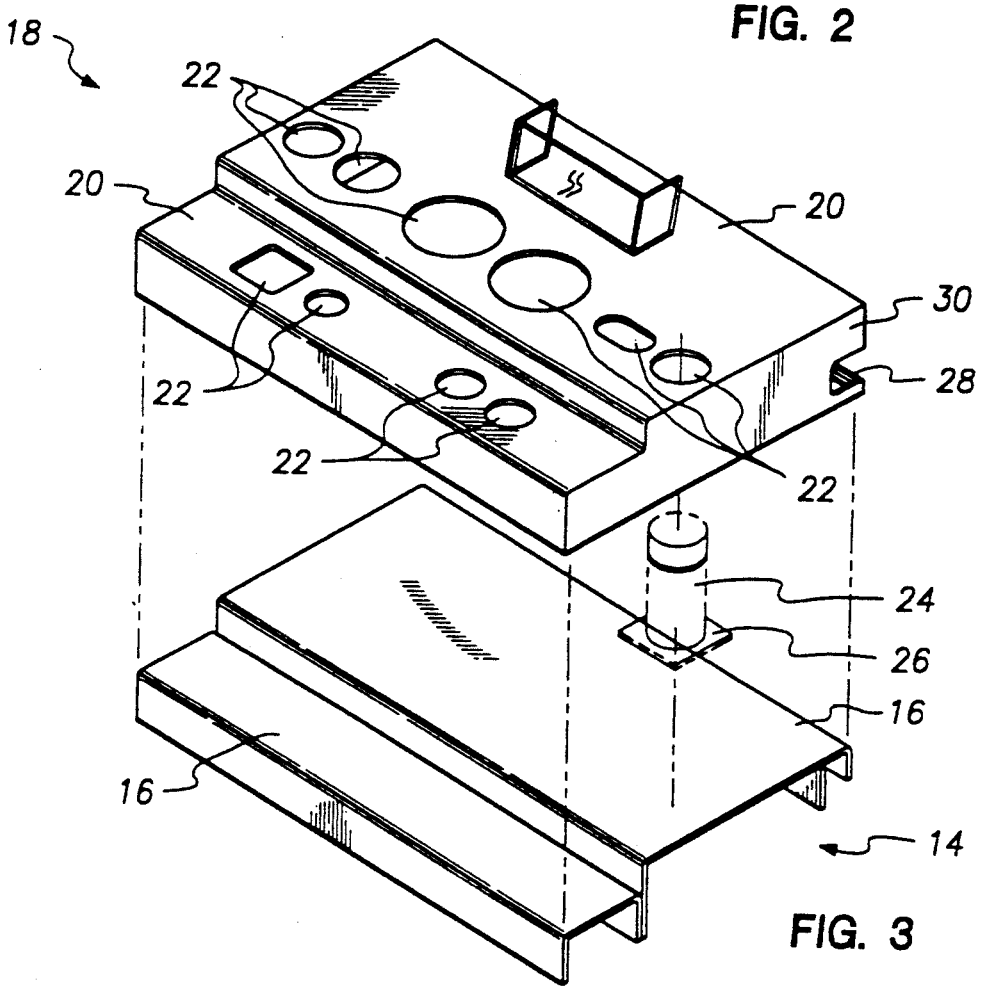
FIG. 3 is an exploded view of the enclosure portion and support portion of the device.
Figure 4:
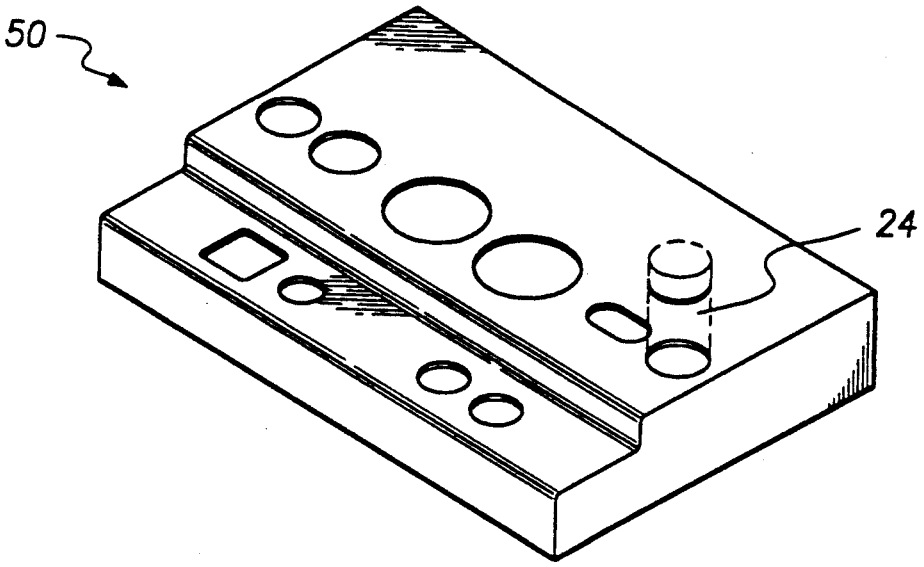
FIG. 4 is a perspective view of another embodiment of the device.
Figure 5:
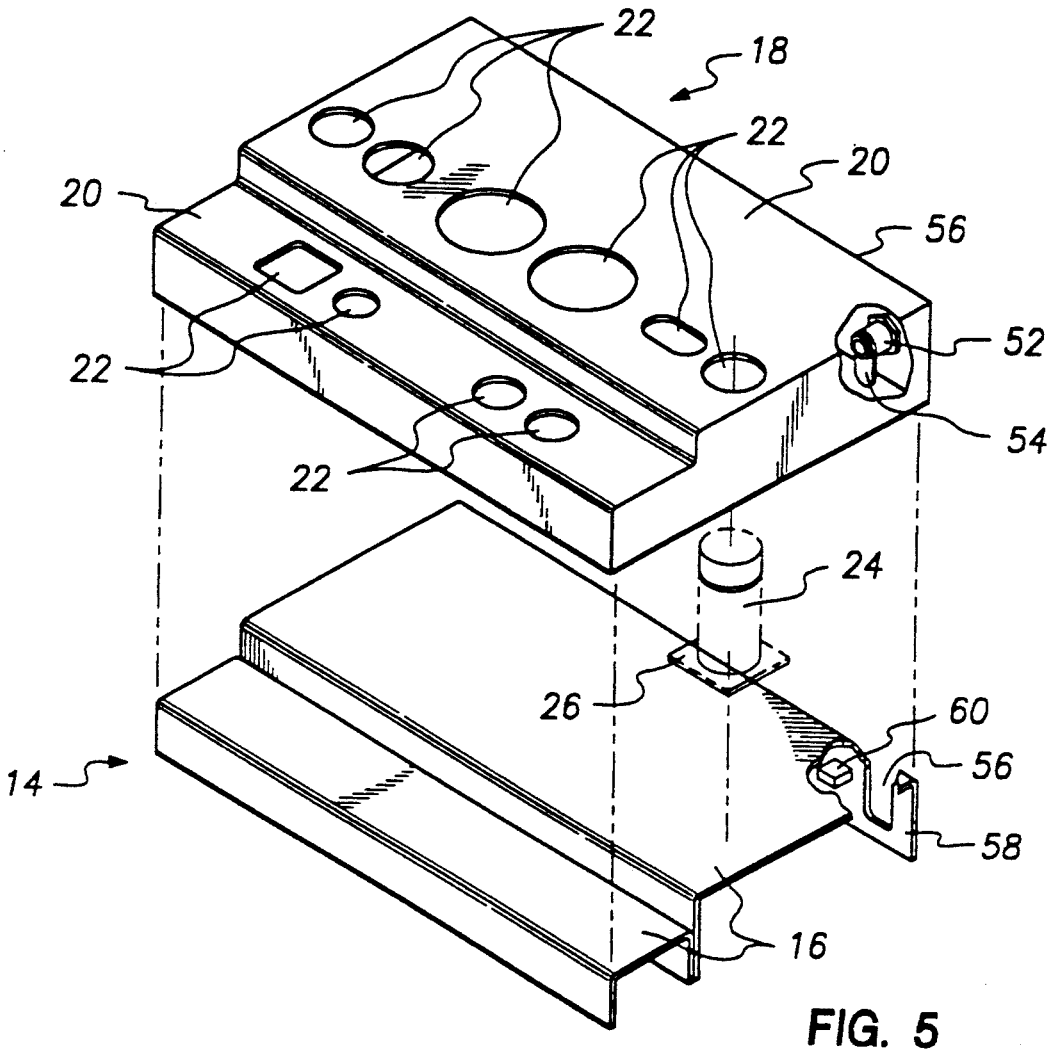
FIG. 5 is an exploded view of the device of FIG. 4.

Referring to FIGS. 1–3, a first embodiment of the anti-theft tester display stand 10 of the invention is shown. The display stand 10 has a housing portion (or member) 12, a support portion (or member) 14 with two generally horizontal surfaces 16, and an enclosure portion (or member) 18, with two generally horizontal surfaces 20. Formed into these horizontal surfaces 20 are numerous openings 22 of various size and shape through which containers of e.g., cosmetic testers 24 (shown in phantom lines), with a plate (or base member) 26 permanently fixed to the base of the container of cosmetic tester 24 pass. The openings 22 are sized to receive the shape of the containers of cosmetic testers 24, and the plate 26 affixed thereto is oversized relative to the corresponding opening 22.

Figure 6:
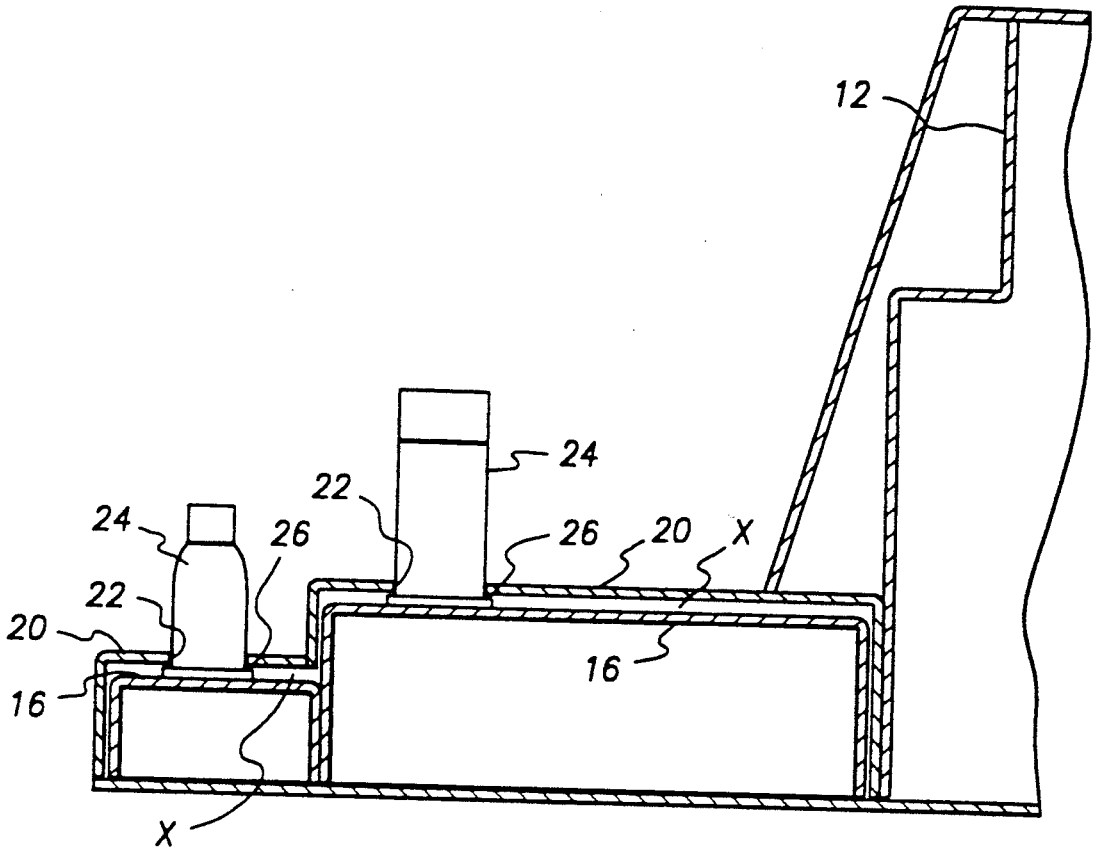
FIG. 6 is a cross-sectional view of the embodiment of device of FIG. 1, illustrating the position of a cosmetic tester and its attached base plate in the device.
Figure 7:
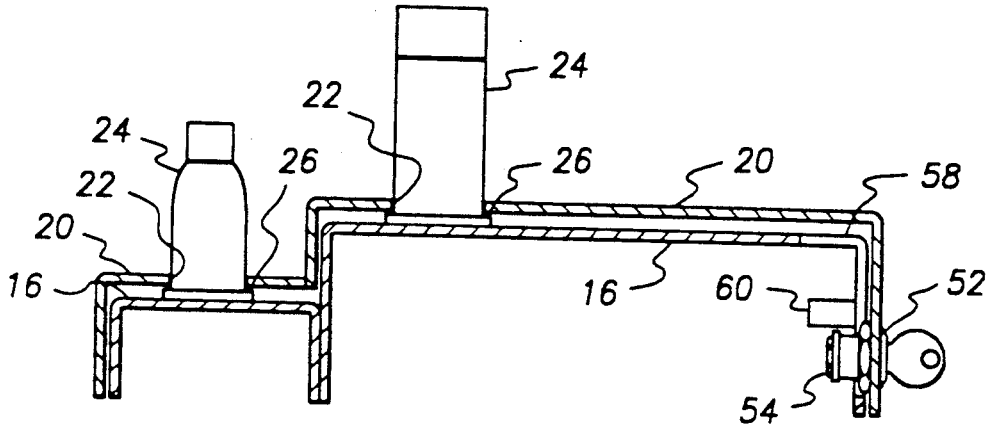
FIG. 7 is a cross-sectional view of the embodiment of the device of FIG. 4.
Figure 8:
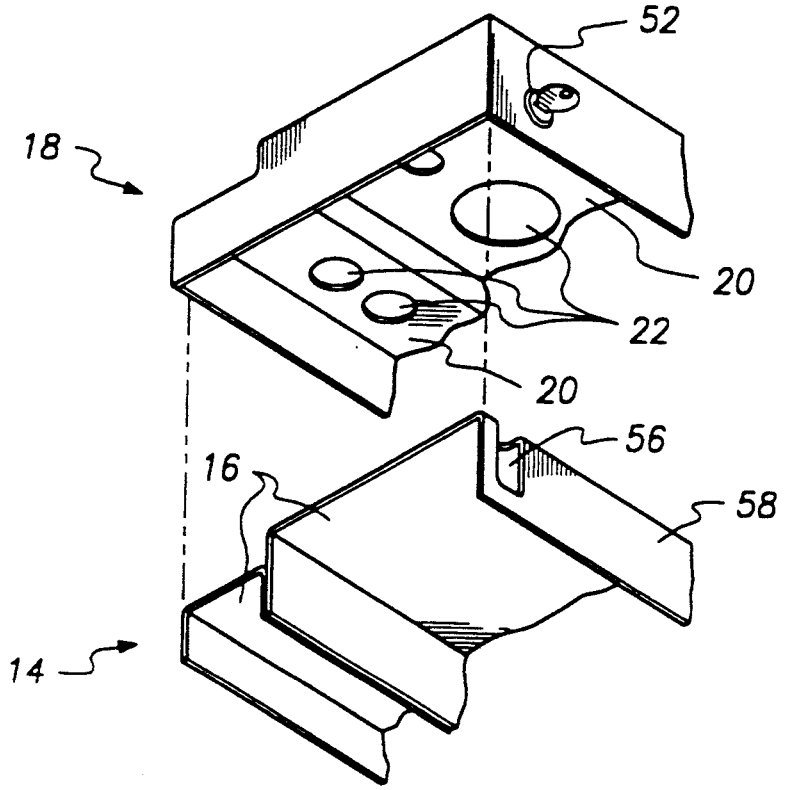
FIG. 8 is an underside partial exploded view of the device of FIG. 4.

As shown in FIG. 6, the top surface of the generally horizontal surfaces 16 is spaced to lie below the bottom surface of the generally horizontal surface 20, by a distance of "X," wherein "X" is greater than the thickness of the plate 26. Referring to FIG. 3, two cutouts 28 are located on side walls 30 and on the back wall portion 18. These cutouts 28 are sized to receive the throw bars 32 of key locks 34 positioned on the two sides of the housing portion 12. After the support portion 12 and the enclosure portion 18 are assembled as shown in FIGS. 2 and 3, they are slid as a unit onto the platform 38 of the housing portion 12, between its two sides 36. After being brought to the position shown in FIG. 1, the locks 34 can be locked, turning the throw bars 32, and thereby immobilizing and locking the enclosure portion 19 and support portion 14 within the housing portion 12. Thus, locked, cosmetic testers 24 will be readily displayed, yet will not be subjected to shoplifting.

Turning to FIGS. 4–5 and 7–8, a second embodiment of the anti-theft cosmetic tester display stand 50 of the invention is shown. This device 50 is similar to that of FIGS. 1–4, but it lacks a housing portion. The same reference numerals are used to identify the same features/elements and the description of these featured elements is incorporated by reference.

A pair of locks 52 with throw bars 54 are located on the rear wall 56 of the enclosure portion 18. The support portion 14 has a pair of slots 56 located on its rear wall 58. These slots 56 (one of which is shown), communicate with its rearmost generally horizontal surface 16, and these slots are aligned to receive the lock 52. When the lock 52 on the enclosure portion 18 is activated, its throw bar 54 (see FIGS. 5 and 7) will be moved from a vertical orientation to a horizontal position (shown in FIG. 7), where it will make contact with a stop 60 positioned on the inside of the rear wall 58 on the support portion 14. This contact will thus prevent the support portion 14 from being disengaged from the enclosure portion 18.

As with the embodiment of FIGS. 1–3 and 6, the containers of cosmetic testers 24 with plates 26 affixed to their base are placed on the generally horizontal surface 16 of the support portion 14, with the containers 24 aligned with the openings 22. Thereafter, the enclosure portion 18 is lowered over the support portion 14, thereby sandwiching the plates 2 between the generally horizontal surfaces 20 and 16 and immobilizing the containers 24.

It should be borne in mind that the drawings are not rendered in actual scale so that certain features of the invention can be brought out and depicted.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following claims:

I claim:

1. A product display stand incorporating at least one tester for a particular product lockably mounted therein, comprising:

a support member;

a cover member lockably mounted onto said support member, said cover member having at least one opening therein, dimensioned so as to permit a lower end of said tester to pass therethrough; and a base member, affixed to said tester, oversized with respect to said opening so as not to be passable through said opening in said cover member;

whereby when said tester and said base member are placed on said support and said cover member is lockably mounted to said support, said tester will be locked between said support member and said cover member, thereby preventing said tester from being removed.

2. The product display stand of claim 1, wherein said cover member and said support member, are lockably retained in a housing member.

3. An anti-theft cosmetic tester display stand for use with containers of cosmetic testers, comprising:

a support member;

a cover member which is sized to fit over said support member, having at least one aperture formed therethrough, said at least one aperture being slightly larger than a container of cosmetic tester;

a lock means to selectively lock said cover member portion over said support member such that a space is formed between an upper surface of said support member and a lower surface of said cover member when engaged; and at least one base member, thinner in thickness than said space, and larger in size than said at least one aperture, for permanent affixation to a bottom surface of a container of cosmetic tester;

whereby when said at least one base member is permanently fixed to a container of cosmetic tester, and an upper portion of said base member affixed container of cosmetic tester is positioned to pass through said at least one aperture, and said support member and said cover member are locked together, said base member will be locked in said space and said container will be prevented from being removed from said display stand.

4. The anti-theft cosmetic tester display stand for use with containers of cosmetic testers of claim 3, wherein said base members are permanently adhesively affixed to said containers of cosmetic testers.

5. The anti-theft cosmetic tester display stand for use with containers of cosmetic testers of claim 3, wherein said cover member has side walls which surround sides of said support member.

6. The anti-theft cosmetic tester display stand for use with containers of cosmetic testers of claim 3, wherein said at least one aperture passes through a generally horizontal region of said cover member and said container sits on a generally horizontal region of said support member.

7. An anti-theft cosmetic tester display stand for use with containers of cosmetic testers, comprising:

a support member;

a cover member which is sized to fit over said support member and which has at lest one aperture formed therethrough, said at least one aperture being dimensionally slightly larger than the containers of cosmetic testers, wherein when said cover member is fit over said support member, a spaced is formed between an upper surface of said support member and a lower surface of said cover member;

a housing member into which said cover member, engaged with said support member, can be engaged;

a lock means to selectively lock said cover member, support member and housing member together; and at least one base member, thinner in thickness than said space, and sized larger than said at least one aperture, for permanent affixation to a bottom surface of a container of cosmetic tester;

whereby when said at least one base member is permanently fixed to a container of cosmetic tester, and an upper portion of said container of cosmetic tester is positioned to pass through said at least one aperture, and said support member, said cover member, and said housing member are locked together, said base member will be locked in said space and said base member affixed container will be prevented from being removed from said display stand.

8. The anti-theft cosmetic tester display stand for use with containers of cosmetic testers of claim 7, wherein said base member is permanently adhesively affixed to said container of cosmetic testers.

9. The anti-theft cosmetic tester display stand for use with containers of cosmetic testers of claim 7, wherein said lock means comprise a lock with a locking bar, said lock being positioned on said housing member, and slots formed on said support member and cover member to lockably receive said locking bar and thereby selectively lock said support member, said cover member and said housing member together.

10. The anti-theft cosmetic tester display stand for use with containers of cosmetic testers of claim 3, wherein said lock means comprises a lock with a locking bar, said lock being positioned on said cover member, and slots formed on said support member to lockably receive said locking bar and thereby selectively lock said cover member and said support member together.

11. An anti-theft cosmetic tester display stand for use with containers of cosmetic testers, comprising:

a support member;

a cover member which is sized to fit over said support member and which has at least one aperture formed therethrough, said at least one aperture being dimensionally slightly larger than the containers of cosmetic testers, wherein when said cover member is fit over said support member, a space is formed between an upper surface of said support member and a lower surface of said cover member;

a housing member into which said cover member, engaged with said support member, can be engaged;

a lock means to selectively lock said cover member, support member and housing member together, said lock means comprising a lock with a locking bar, said lock being positioned on said housing member, and slots formed on said support member and cover member to lockably receive said locking bar;

at least one base member, thinner in thickness than said space, and sized larger than said at least one aperture, for permanent affixation to a bottom surface of a container of cosmetic tester;

whereby when said at least one base member is permanently fixed to a container of cosmetic tester, and an upper portion of said container of cosmetic tester is positioned to pass through said at least one aperture, and said support member, said cover member, and said housing member are locked together, said base member will be locked in said space and said base member affixed container will be prevented from being removed from said display stand.

12. The anti-theft cosmetic tester display stand for use with containers of cosmetic testers of claim 11, wherein said base member is permanently adhesively affixed to said containers of the cosmetic testers.

* * * * *